US011789407B2

(12) United States Patent
Kahrobaiyan et al.

(10) Patent No.: US 11,789,407 B2
(45) Date of Patent: Oct. 17, 2023

(54) PIVOTING GUIDE DEVICE FOR A PIVOTING MASS AND TIMEPIECE RESONATOR MECHANISM

(71) Applicant: The Swatch Group Research and Development Ltd, Marin (CH)

(72) Inventors: Mohammad Hussein Kahrobaiyan, Neuchâtel (CH); Gianni Di Domenico, Neuchâtel (CH)

(73) Assignee: The Swatch Group Research and Development Ltd, Marin (CH)

( * ) Notice: Subject to any disclaimer, the term of this patent is extended or adjusted under 35 U.S.C. 154(b) by 265 days.

(21) Appl. No.: 17/065,648

(22) Filed: Oct. 8, 2020

(65) Prior Publication Data

US 2021/0124307 A1 Apr. 29, 2021

(30) Foreign Application Priority Data

Oct. 24, 2019 (EP) ..... 19205001

(51) Int. Cl.
*G04B 17/04* (2006.01)
*G04B 17/28* (2006.01)

(52) U.S. Cl.
CPC ..... *G04B 17/045* (2013.01); *G04B 17/28* (2013.01)

(58) Field of Classification Search
CPC ..... G04B 17/04; G04B 17/045; G04B 17/28
See application file for complete search history.

(56) References Cited

U.S. PATENT DOCUMENTS

2013/0176829 A1* 7/2013 Cusin ..... G04B 17/045 368/127
2016/0179058 A1 6/2016 Born et al.
2018/0284695 A1* 10/2018 Maier ..... G04B 17/045
2019/0064742 A1* 2/2019 Di Domenico ..... G04B 17/045
2019/0120287 A1* 4/2019 Cosandier ..... F16D 3/005

FOREIGN PATENT DOCUMENTS

| | | | |
|---|---|---|---|
| CH | 712958 | A2 | 3/2018 |
| CN | 105717777 | A | 6/2016 |
| EP | 3 035 127 | A1 | 6/2016 |
| EP | 3 438 762 | A2 | 2/2019 |
| JP | 2016-118548 | A | 6/2016 |

OTHER PUBLICATIONS

Office Action dated Aug. 27, 2021 in Chinese Application No. 202011144579.0.
Communication dated Aug. 31, 2021 from the Japanese Patent Office in Application No. 2020-173709.
European Search Report for corresponding EP 19 20 5001, dated Apr. 7, 2020.

* cited by examiner

*Primary Examiner* — Sean Kayes
(74) *Attorney, Agent, or Firm* — Sughrue Mion, PLLC

(57) ABSTRACT

A device (10) for guiding a pivoting mass in rotary pivoting, in particular for a horological movement comprising, arranged in series substantially in the same plane, a first support (2), a first pair of uncrossed strips (5, 6), a second support (3), a pair of crossed strips (7, 8), and a third support (4), the pair of uncrossed strips including, a first (5) and a second (6) flexible strip connecting the first support (2) to the second support (3) without crossing each other, the pair of crossed strips including a third (7) and a fourth (8) flexible strip connecting the second support (3) to the third support (4), the third (7) and fourth (8) flexible strips crossing each other between the second (3) and the third (4) support.

17 Claims, 5 Drawing Sheets

PIVOTING GUIDE DEVICE FOR A PIVOTING MASS AND TIMEPIECE RESONATOR MECHANISM

CROSS REFERENCE TO RELATED APPLICATIONS

This application claims priority to European Patent Application No. 19205001.1 filed Oct. 24, 2019, the entire contents of which are incorporated herein by reference.

FIELD OF THE INVENTION

The invention relates to a device for guiding a pivoting mass in rotary pivoting.

The invention also relates to a timepiece resonator mechanism including such a pivoting guide device.

The invention also relates to a horological movement comprising such a resonator mechanism.

BACKGROUND OF THE INVENTION

Horological movements generally comprise a barrel, an escapement mechanism and a mechanical resonator mechanism. The resonator mechanism comprises a spring associated with an oscillating inertia-block called a balance and a pivot. Flexible guides are now used as a spring to form a virtual pivot.

The flexible virtual pivot guides allow to significantly improve timepiece resonators. The simplest are crossed-strip pivots, composed of two guide devices with straight strips which cross each other, generally perpendicularly. These two strips can be either three-dimensional in two different planes, or two-dimensional in the same plane and are then as welded at their crossing point.

It is possible to optimise a three-dimensional crossed-strip pair for a resonator, to try to make it isochronous with an operation independent of its orientation in the gravity field, particularly in two ways (independently, or both together):

- selecting the crossing position of the strips relative to their fitting in order to have an operation independent of the positions;
- selecting the angle between the strips to be isochronous, and have an operation independent of the amplitude.

However, it is not possible to obtain a sufficient angular travel of the flexible guide for its application in a horological movement to be efficient. Indeed, the greatest angular travel is obtained when the strips cross each other in their respective middle. However, in this configuration, it is not possible to achieve sufficient isochronism. Thus, it is not possible to obtain a sufficiently stable virtual axis during the pivoting for the rotary movement of the mass to be perfectly periodic. The return torque is not entirely linear, which generates anisochronism depending on the amplitude of the mass and an error of the operation of the movement. Furthermore, the centre of mass of the mechanism shifts too much, and also causes anisochronism due to its orientation relative to gravity.

SUMMARY OF THE INVENTION

The invention seeks to avoid the aforementioned defects and aims at obtaining a flexible guide having an improved behaviour, in particular for their use in a resonator mechanism of a horological movement.

The invention thus relates to a device for guiding a pivoting mass in rotary pivoting, in particular for a horological movement.

The device is remarkable in that it comprises, arranged in series substantially in the same plane, a first support, a first pair of uncrossed strips, a second support, a pair of crossed strips and a third support, the pair of uncrossed strips comprising, a first and a second flexible strip connecting the first support to the second support without crossing each other, the pair of crossed strips including a third and a fourth flexible strip connecting the second support to the third support, the third and fourth flexible strips crossing each other between the second and the third support.

Thus, by assembling in series one of the supports separated by a pair of crossed strips and a pair of uncrossed strips, a flexible guide is obtained having, on the one hand, a sufficient angular travel, and on the other hand, an isochronism of the movement of the mass. Indeed, the second support and the pair of uncrossed strips form a first uncrossed-strip pivot, while the third support and the uncrossed strips form an uncrossed-strip pivot. However, a crossed-strip pivot generates a lack of positive linearity of the torque-angle relationship, which compensates for a lack of negative linearity generated by an uncrossed-strip pivot. Each type of pivot then induces parasitic movements opposite to each other, which cancel each other out.

Thanks to the invention, it is possible to use efficient flexible strip pivots in resonator mechanisms of horological movement. Such a device allows to keep a more stable centre of mass during the pivoting of the mass, so that the flexibility and the return torque are more linear, or else having a selected lack of linearity, for example to compensate for an escapement delay. The problems of anisochronism and operation change due to gravity are also greatly reduced, in particular in a resonator mechanism, so that mechanical horological movements are more precise.

According to a particular embodiment of the invention, the device includes a fourth support and a second pair of uncrossed strips, the second pair of uncrossed strips including a fifth and a sixth flexible strip connecting the third support to the fourth support without crossing each other.

According to a particular embodiment of the invention, the device includes a fifth and a sixth support.

According to a particular embodiment of the invention, the device includes a third and a fourth pair of uncrossed strips, the third one being mounted between the first support and the fifth support, and the fourth one being mounted between the fourth and the sixth support.

According to a particular embodiment of the invention, the fifth support is arranged between the first and the second support, and the sixth support is arranged between the third and the fourth support, when the device is at rest.

According to a particular embodiment of the invention, the fifth support is arranged beyond the first support, and the sixth one is arranged beyond the fourth support.

According to a particular embodiment of the invention, the third pair of uncrossed strips is arranged in a head-to-tail position with the first pair of uncrossed strips, and the fourth pair of uncrossed strips is arranged in a head-to-tail position with the second pair of uncrossed strips.

According to a particular embodiment of the invention, the second and the third support include arms for holding the flexible strips.

According to a particular embodiment of the invention, the first and the fourth support include arms for holding the flexible strips.

According to a particular embodiment of the invention, the fifth support is intended to be fixed, the other supports being intended to be movable, the sixth support being intended to form or support the pivoting mass.

According to a particular embodiment of the invention, the device includes two assemblies of supports and pairs of superimposed strips, one of the supports forming a support common to the two assemblies.

According to a particular embodiment of the invention, the first support is intended to be fixed, the other supports being intended to be movable, the third support being intended to form or support the pivoting mass.

According to a particular embodiment of the invention, the third support is intended to be fixed, the other supports being intended to be movable, the first support being intended to form or support the pivoting mass.

According to a particular embodiment of the invention, two flexible strips of the same pair are of equal length.

According to a particular embodiment of the invention, two strips of a pair of crossed strips cross each other substantially at their centre.

The invention also relates to a timepiece resonator mechanism including a pivoting mass arranged to rotatably pivot about a virtual pivot axis, the mechanism comprising a rotary pivoting flexible guide device according to the invention.

The invention also relates to a horological movement comprising such a timepiece resonator mechanism.

BRIEF DESCRIPTION OF THE DRAWINGS

Other features and advantages of the invention will become apparent upon reading the detailed description which follows, with reference to the appended drawings, where.

DETAILED DESCRIPTION

The invention relates to a device for guiding a pivoting mass in rotary pivoting, for example for a resonator mechanism including a pivoting mass in a horological movement.

Figure 1:
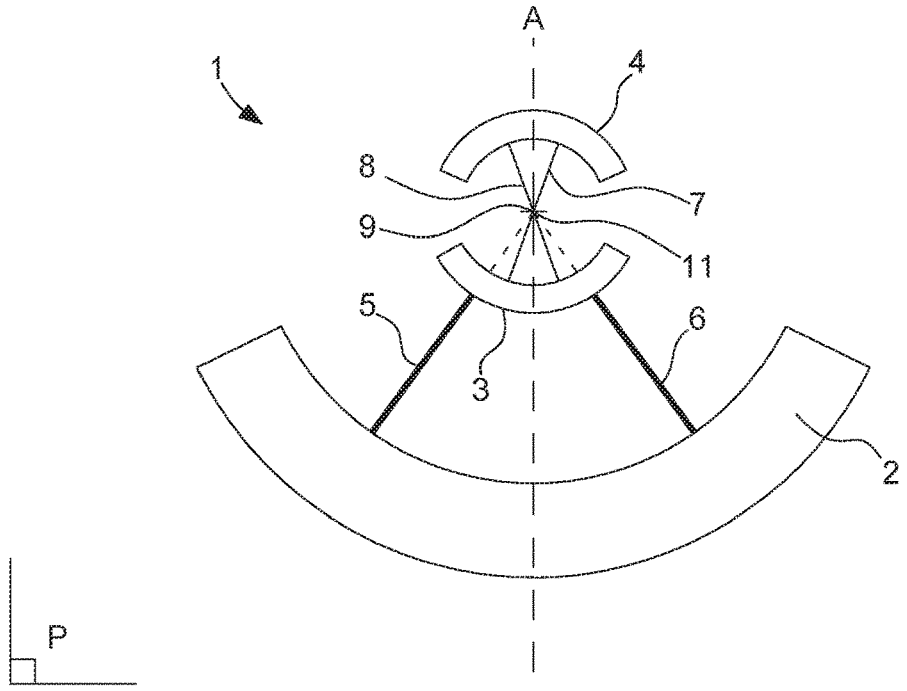
FIG. 1 schematically shows a top view of a pivoting guide device according to a first embodiment of the invention, FIG. 2 schematically shows a perspective view of a pivoting guide device according to a second embodiment of the invention, FIG. 3 schematically shows a top view of a pivoting guide device according to a third embodiment of the invention, FIG. 4 schematically shows a top view of a pivoting guide device according to a fourth embodiment of the invention, FIG. 5 schematically shows a top view of a pivoting guide device according to a fifth embodiment of the invention, FIG. 6 schematically shows a top view of a pivoting guide device according to a sixth embodiment of the invention, FIG. 7 schematically shows a top view of a pivoting guide device according to a seventh embodiment of the invention, FIG. 8 schematically shows a top view of a resonator mechanism comprising a variable inertia balance and a guide device according to the invention, FIG. 9 schematically shows a top view of a disassembled resonator mechanism comprising a balance and a guide device according to the invention, FIG. 10 schematically shows a top view of a shockproof table and a guide device according to the invention.

FIG. 1 shows a first basic embodiment of such a device 1 according to the invention. The device 1 is, preferably, arranged substantially in the same plane P. The device 1 comprises, from upstream to downstream, mounted in series according to the arrangement of the guide device, a first fixed support 2, a pair of uncrossed strips 5, 6, a second rotary support 3, a pair of crossed strips 7, 8 and a third support 4 intended to form or support the pivoting mass.

The three supports 2, 3, 4 here have the shape of a circular arc forming an angle comprised between 60 and 120°. The arc of the first support 2 is larger than that of the second one 3, and the third one 4 in FIG. 1, with a ratio of at least one to two, or even one to three or four. The first 2 and the second support 3 are parallel, but the third support 4 is arranged symmetrically in the other direction, the interior of the arc being opposite that of the second support 3.

Of course, in variant embodiments, the supports 2, 3, 4 may have shapes that are different from those shown in the figures, for example straight shapes.

The pair of uncrossed strips 5, 6 comprises a first 5 and a second flexible strip 6 connecting the first support 2 to the second support 3. The two flexible strips 5, 6 are of the same length, and are arranged symmetrically relative to the axis A of the device 1, when the device is in the rest position. The flexible strips 5, 6 extend from the inside of the arc of the first support 2, to the outside of the arc of the second support 3. The first support 2 being larger than the second one 3, the two strips 5, 6 move towards each other while moving towards the second support 2. However, the first 5 and the second flexible strip 6 do not cross each other between the two supports. Thus, each of them is oriented in one direction, the two directions intersecting at a first virtual point 9 beyond the supports, here beyond the second support 3. The two strips are in the same plane and form therebetween an angle comprised between 5 and 130°, preferably between 25 and 110°.

The pair of crossed strips 7, 8 includes a third 7 and a fourth 8 flexible strip connecting the second support 3 to the third support 4. The third 7 and fourth 8 flexible strips are of the same length, which is here shorter than the first 5 and the second 6 strip of the pair of uncrossed strips. The third 7 and the fourth 8 flexible strip are slightly offset in height to avoid touching each other during the oscillations of the device 1. They form therebetween an angle comprised between 0° and 180°, preferably between 20° and 50°. The third 7 and the fourth 8 flexible strip cross each other at a second point 11 located between the second 3 and the third 4 support when the device 1 is at rest. Preferably, the second point 11 is arranged in the middle of the two strips 7, 8. In other words, the third 7 and the fourth 8 strip cross each other at their respective centres. Preferably, the dimensions of the strips 5, 6, 7, 8 and the supports 2, 3, 4 are selected, so that the first 9 and the second point 11 are located substantially in the same place when the device 1 is at rest, as shown in FIG. 1.

The strips 5, 6, 7, 8 advantageously have an inertia of similar or even identical section. For example, flexible strips 5, 6, 7, 8 usually used in watchmaking in resonator mechanisms. The invention is illustrated in a particular preferred case where the flexible strips 5, 6, 7, 8 are straight. Other geometries are nevertheless considered, for example in the shape of a coil, or the like.

When the device 1 oscillates, the first support 2 remains fixed, the second support 3 oscillates thanks to the first 5 and the second 6 flexible strip at a first angle of travel, and the third support 4 oscillates thanks to the third 7 and to the fourth 8 flexible strip at a second angle of travel greater than the first angle. The oscillation takes place around a virtual axis perpendicular to the plane of device 1.

As the pair of crossed strips 7, 8 and the pair of uncrossed strips 5, 6 compensate for their defects, an isochronous oscillation is obtained, without parasitic movement of the centre of mass of the device 1. Furthermore, the angular travel of the two types of pivots is added to obtain a sufficiently large angular travel, in particular to be able to be used in a timepiece oscillation mechanism.

In a variant of this first embodiment, the third support 4 is fixed, while the first 2 and the second 3 support are movable, the first support 2 being intended to form or support the inertia-block of the oscillation mechanism. Thus, the second support 3 has an angular travel less than that of the first support 2 in this case.

Figure 2:
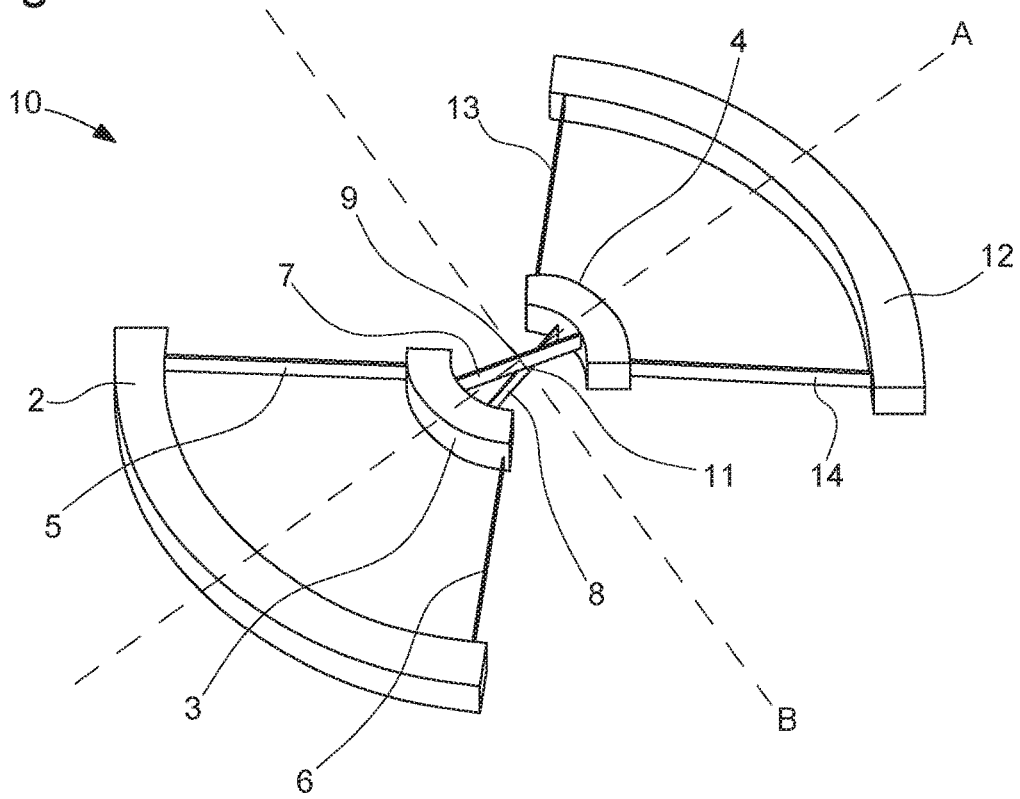

According to a second embodiment, shown in FIG. 2, the device 10 includes a second pair of uncrossed strips 13, 14 mounted in series with the pair of crossed strips 7, 8, as well as a fourth support 12 intended to form or to support the pivoting mass. Thus, a second uncrossed-strip 13, 14 pivot is formed in series with the crossed-strip pivot. The pair of crossed strips 7, 8 is arranged between two pairs of uncrossed strips 5, 6, 13, 14. In this case, the third support 4 is not intended to form or support the pivoting mass, but it remains movable, while the first support 2 is fixed. The fourth support 12 has, in the illustrated example, the same circular arc shape and the same size as the first support 2, but it is arranged in the other direction parallel to the third support 4.

The fourth support 12 and the second pair of uncrossed strips 13, 14 are arranged by symmetry of the first pair of uncrossed strips 5, 6 and of the first support 2 relative to the axis of symmetry B of the device 1, which is perpendicular to the axis A. The axis of symmetry A of the device 1 passes through all the supports 2, 3, 4, 12, while the axis of symmetry B does not pass through the supports 2, 3, 4, 12. The second pair of uncrossed strips 13, 14 includes a fifth 13 and a sixth flexible strip 14 connecting the third support 4 to the fourth support 12 without crossing each other, in the same way that the first pair of uncrossed strips 5, 6 connects the first support 2 to the second one 3.

The directions of the strips 13 and 14 intersect at a virtual point beyond the supports 4 and 12, which is located substantially at the first and second points 9 and 11. The first 9 and the second 11 point form the centre of rotation of the device 10.

According to a first variant, the device 10 is configured so that the centre of mass of the balance is arranged on the centre of rotation of the device 10.

In a second variant, the device 10 is configured so that the centre of mass of the balance is arranged at a predefined distance from the centre of rotation of the device 10, on the axis A.

The dimensions of the pivots are selected so that the two uncrossed-strip pivots compensate for the anisochronism of the crossed-strip pivot.

Figure 3:
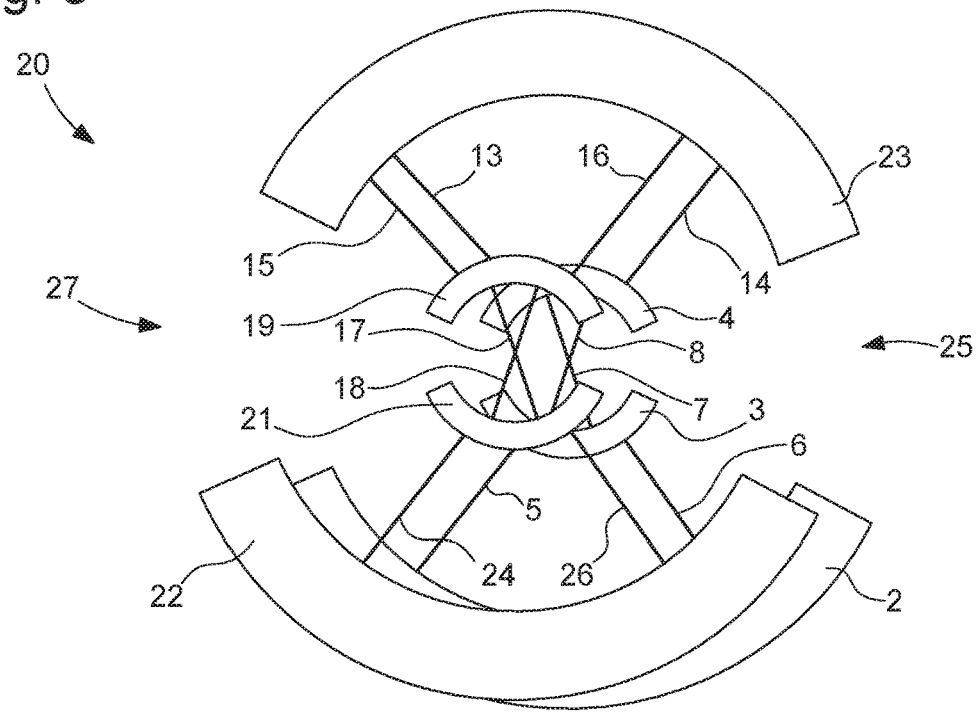

In a third embodiment, shown in FIG. 3, the device 20 includes two assemblies 25, 27, each assembly 25, 27 corresponding to a guide device according to the second embodiment of FIG. 2, the two assemblies 25, 27 being superimposed. The two assemblies 25, 27 are arranged on two parallel planes in order to be able to pivot without colliding the strips or the supports. The first assembly 25 is arranged below the second assembly 27 in FIG. 3. The two assemblies 25, 27 are superimposed head-to-tail and connected to each other by a common movable support 23 forming the fourth support of the first assembly 25 and also the first support of the second assembly 27. Thus, the angular travel of the device 20 is increased thanks to this mounting in series. In this case, only the first support 2 of the first assembly 25 is fixed, while all the other supports 3, 4, 19, 21, 22 23 are movable. The fourth support 22 of the second assembly 27 has the greatest angular travel and is intended to form or support the pivoting mass. The fifth 13 and the sixth 14 flexible strip of the first assembly 25, as well as the first 15 and the second 16 flexible strip of the second assembly 27 are connected to the common support 23. The other flexible strips 5, 6, 7, 8, 17, 18, 24, 26 are in the same configuration as the device 10 of the second embodiment.

The supports 3, 4, 19, 21, 22 23 and the strips 5, 6, 7, 8, 17, 18, 24, 26 are superimposed in the inverted position when the device 20 is at rest. Thus, the second support 19 of the second assembly 27 is arranged above the third support 4 of the first assembly 25, and the third support 21 of the second assembly 27 is arranged above the second support 3 of the first assembly 25. Finally, the fourth support 22 of the second device 27 is arranged above the first support 2 of the first assembly 25. Thus, the fourth support 22 of the second assembly 27 oscillates above the first fixed support 2 of the first assembly 25, when the device 20 is operating.

Figure 4:
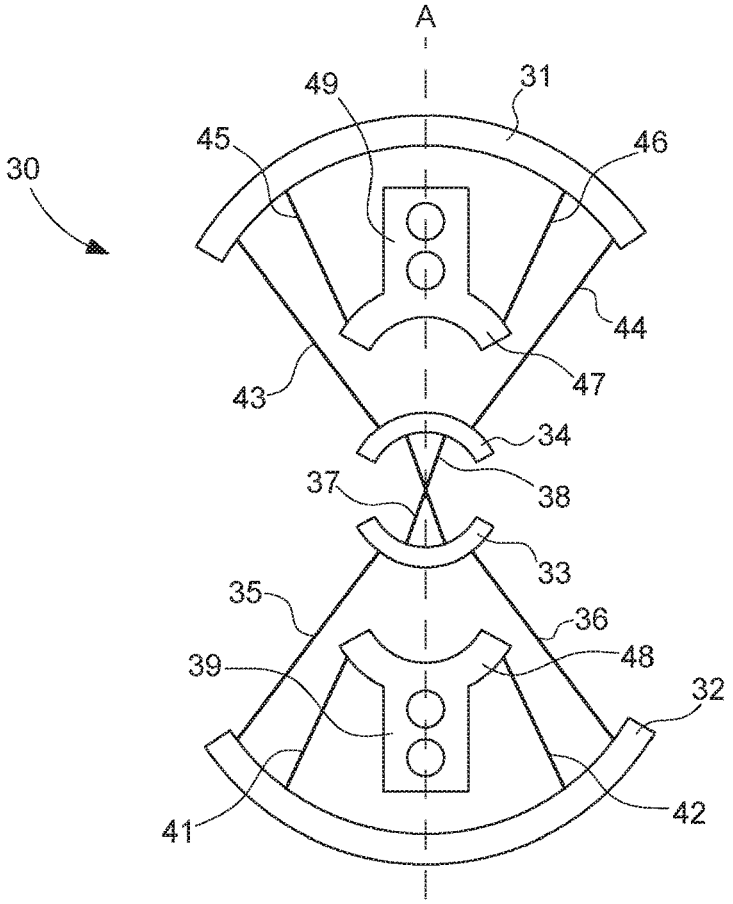
Figure 5:
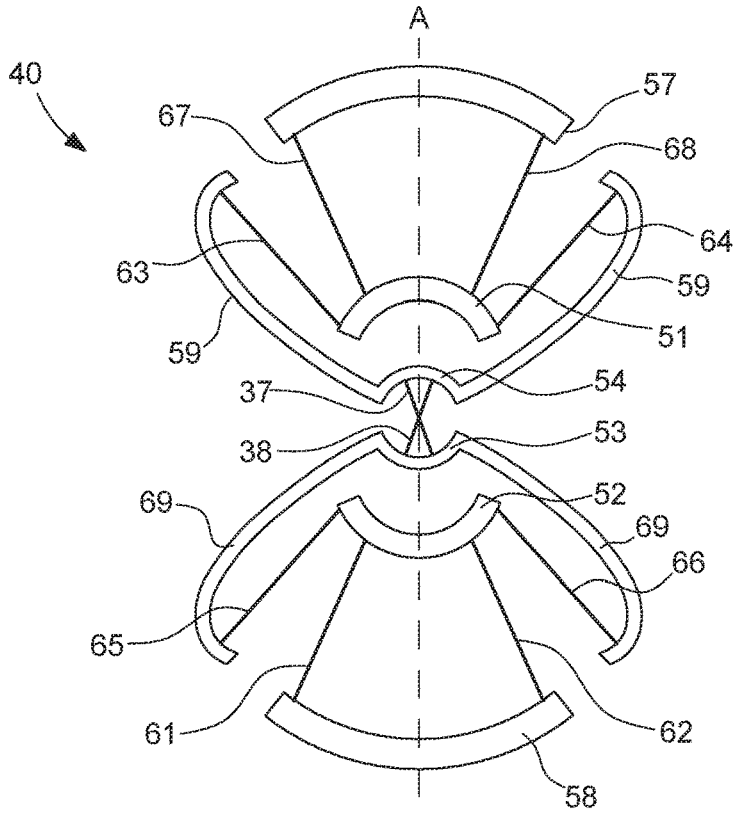
Figure 6:
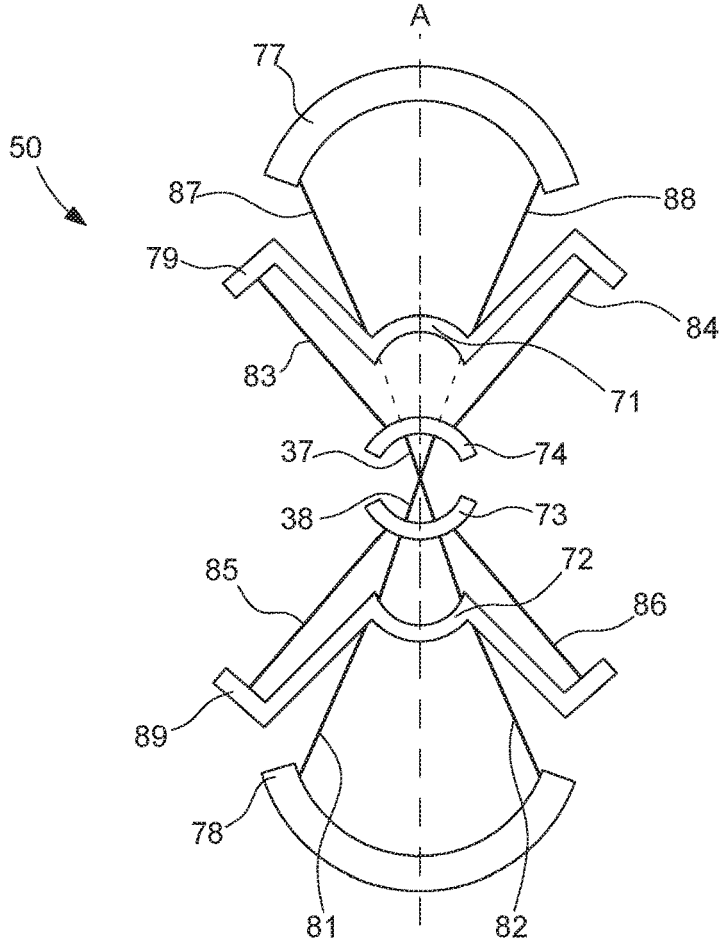

FIGS. 4 to 6 show embodiments wherein the device 30, 40, 50 includes a third and a fourth pair of uncrossed strips 41, 42, 45, 46, 61, 62, 67, 68, 81, 82, 87, 88 in addition to the first two and the pair of crossed strips of the device according to the second embodiment. The third pair 41, 42, 61, 62, 81, 82, is mounted upstream of the first pair of uncrossed strips 35, 36, 65, 66, 85, 86, and the fourth pair 45, 46, 67, 68, 87, 88 is mounted downstream of the second pair of uncrossed strips 43, 44, 63, 64, 83, 84. Furthermore, the device includes a fifth support 48, 58, 78 connected to the first support 32, 52, 72 by the third pair of uncrossed strips 41, 42, 61, 62, 81, 82, as well as a sixth support 47, 57, 77 connected to the fourth support 31, 51, 71 by the fourth pair of uncrossed strips 45, 46, 67, 68, 87, 88. The third pair includes a seventh 41, 61, 81 and an eighth flexible strip 42, 62, 82, and the fourth pair includes a ninth 45, 67, 87 and a tenth flexible strip 46, 68, 88. The strips of a pair are arranged symmetrically on either side of the axis of symmetry A of the device 30, 40, 50. The fifth support 48, 58, 78 and the sixth support 47, 57, 77 also have a circular arc shape, which is the same for each respective device.

In all these embodiments, the first support 32, 52, 72 is movable, while the fifth support 48, 58, 78 is fixed, and the sixth support 47, 57, 77 is intended to form or support the pivoting mass. Furthermore, each device 30, 40, 50 is substantially arranged in a plane.

In the fourth embodiment of FIG. 4, the fifth 48 and the sixth support 47 are arranged, respectively, between the first 32 and the second support 33, and between the third 34 and the fourth support 31. The fifth 48 and sixth 47 supports have a similar circular arc shape and are arranged in the same direction, respectively, as the first 32 and the second support 33 for one, the third 34 and the fourth support 31 for the other. The fifth 43 and sixth flexible strips 44 are arranged on either side of the sixth support 47, when the device is in the rest position.

The fifth 48 and the sixth support 47 each further include a tab-shaped clip 39, 49 including two fixing holes. The tabs are disposed on the outer portion of the arc in the direction, respectively, of the first 32 and fourth supports 31. The first 35 and the second flexible strip 36 are arranged on either side of the fifth support 48, when the device is in the rest position.

The fifth and the sixth embodiment of FIGS. 5 and 6 show a configuration wherein the fifth 58, 78 and the sixth support 57, 77 are arranged, respectively, beyond the first 52, 72 and beyond the fourth support 51, 71. "Beyond" is understood relative to the centre of the device.

For the fifth embodiment, the second and third supports 53, 54 include at each end of the arc, a curved arm 59, 69 extending, respectively, around the first support 52 and the fourth support 51. Thus the four arms 59, 69 describe a deformed arc, the curvature of which is oriented towards the outside of the device 40 and is accentuated as it approaches the free end.

Each free end of the arms is connected to the first 52 or to the fourth support 51, by the first 65 and the second flexible strip 66 for the second support 53, the fifth 63 and the sixth flexible strip 64 for the fourth support 54.

In the device 50 of the sixth embodiment, the first 72 and the fourth support 71 include at each end of the arc, an arm 79 89 extending, respectively, towards the fifth 78 and the sixth support 77. The four arms 79, 89 have the shape of a rectilinear segment, each free end of which is bent substantially at 90°. The two bent ends of the first support 72 are connected to the second support 73 by the first flexible strip 85 for one and the second flexible strip 86 for the other. The two bent ends of the fourth support 71 are connected to the third support 74 by the fifth flexible strip 83 for one and by the sixth flexible strip 84 for the other.

Figure 7:
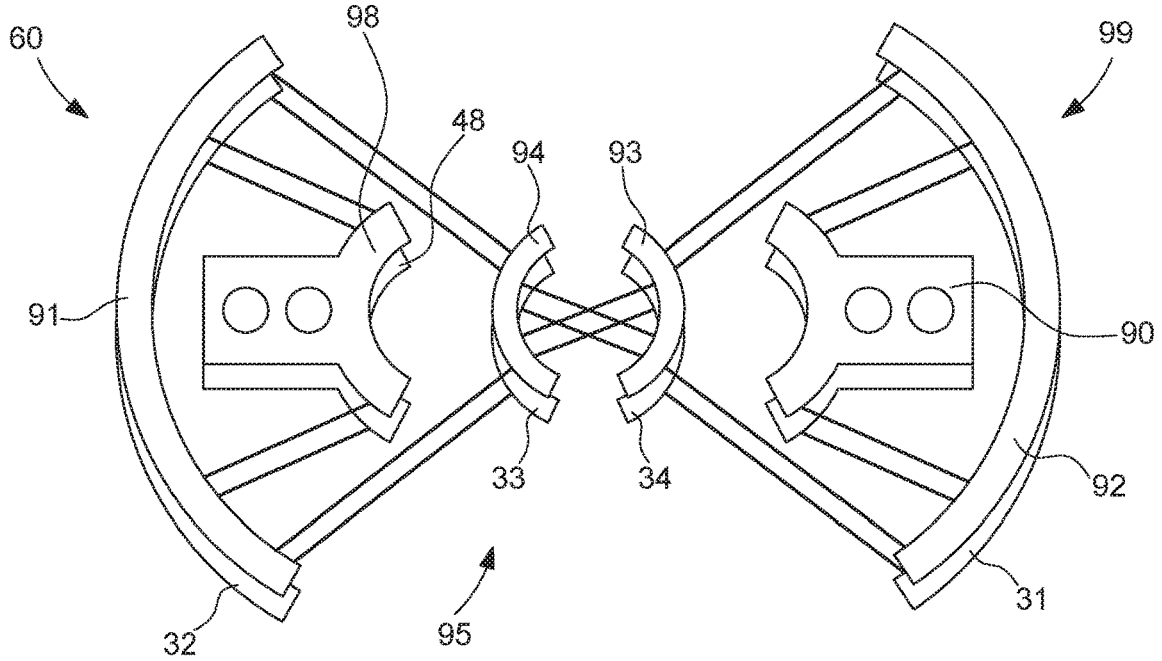

FIG. 7 shows a seventh embodiment of a device 60 including two assemblies 95, 99 of supports and pairs of superimposed strips. Each assembly 95, 99 generally corresponds to the device of the type described for the fourth embodiment. The assemblies 95, 99 are arranged head-to-tail, that is to say, they are inverted relative to each other. The two assemblies 95, 99 are arranged on two parallel planes to be able to pivot without colliding the strips. Thus, a device comprising eight pairs of uncrossed strips and two pairs of crossed strips is obtained. In this device, a common support 90 forms both the sixth support of the first assembly 95 and also the fifth support of the second assembly 99. The device 60 therefore has eleven different supports 31, 32, 33, 34, 48, 90, 91, 92, 93, 94, 98. In the rest position, the first support 32 of the first device 95 is arranged under the fourth support 91 of the second assembly 99, the second support 33 of the first assembly 95 is arranged under the third support 94 of the second assembly 99, the third support 34 of the first assembly 95 is arranged under the second support 93 of the second assembly 99, the fourth support 31 of the first assembly 95 is arranged under the first support 92 of the second assembly 99, and the fifth support 48 of the first assembly 95 is arranged under the sixth support 98 of the second assembly 99.

When the device 60 oscillates, all the supports 31, 32, 33, 34, 90, 91, 92, 93, 94, 98 are movable except the fifth support 48 of the first device 95. The sixth support 98 of the second assembly 99 is intended to form or support the pivoting mass.

Thanks to this mounting in series, the angular travel of the device 60 is further lengthened.

Combinations of devices mounted in series according to the fifth or the sixth embodiment are also possible.

Figure 8:
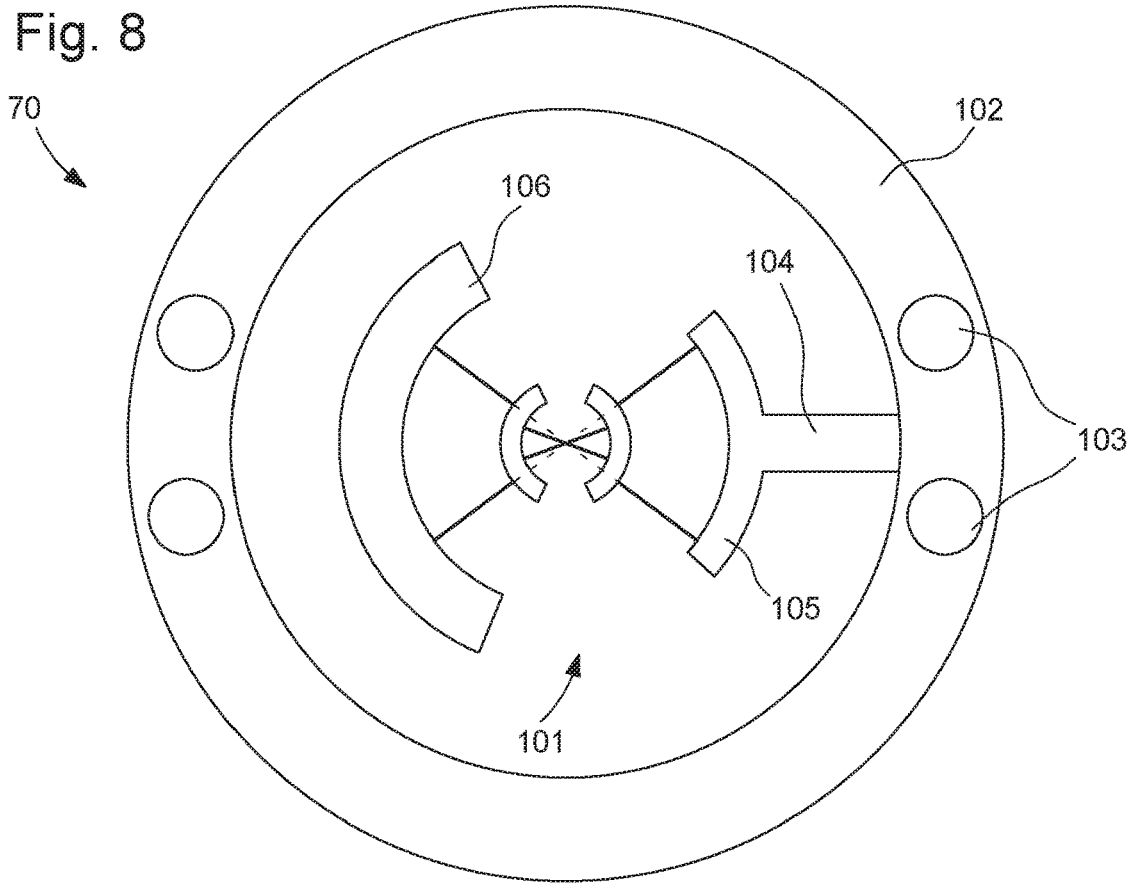

FIG. 8 shows a resonator mechanism 70 comprising a device 101 according to the second embodiment and a monolithic balance 102. The balance 102 has a ring shape connected to the outer side of the fourth support 105 by an axial arm 104, the first support 106 of the device 101 being fixed. The ring surrounds the device 101 while remaining substantially in its plane. The balance 102 further comprises inertia-blocks 103, here four, which are arranged on the ring to modify and adjust the desired centre of mass and inertia for the balance 102. The inertia-blocks are preferably eccentric.

Figure 9:
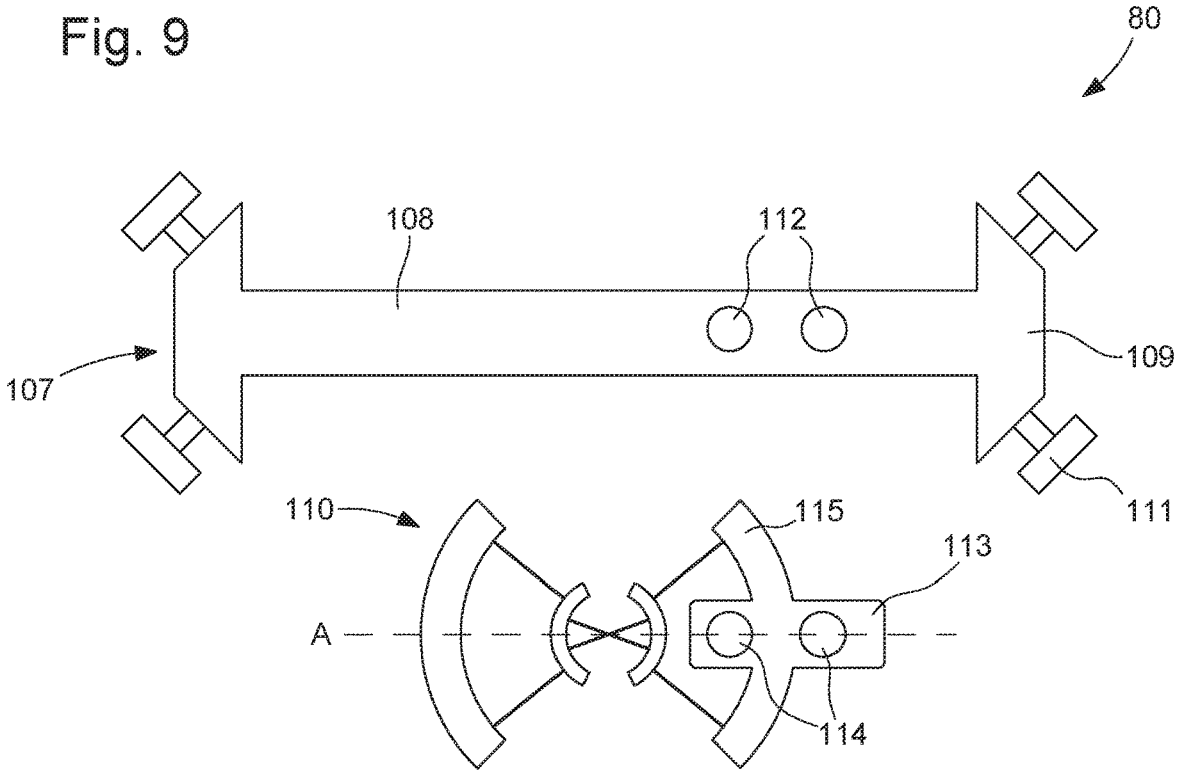

Another type of balance 107 is shown in the resonator mechanism 80 of FIG. 9, above the device 110 according to the invention. The balance 107 comprises an axial arm 108 and a frusto-conical head 109 at each end. The heads 109 are provided with screws 111 that can be actuated to modify the centre of mass and the inertia of the balance 107. The arm 108 includes two orifices 112 to be assembled to the movable support 115 of the device 110 according to the second embodiment. The movable support 115 comprises a clip 113 arranged on the axis A of the device 110 and provided with two holes 114 corresponding to the orifices 112 of the balance 107 for assembling.

Figure 10:
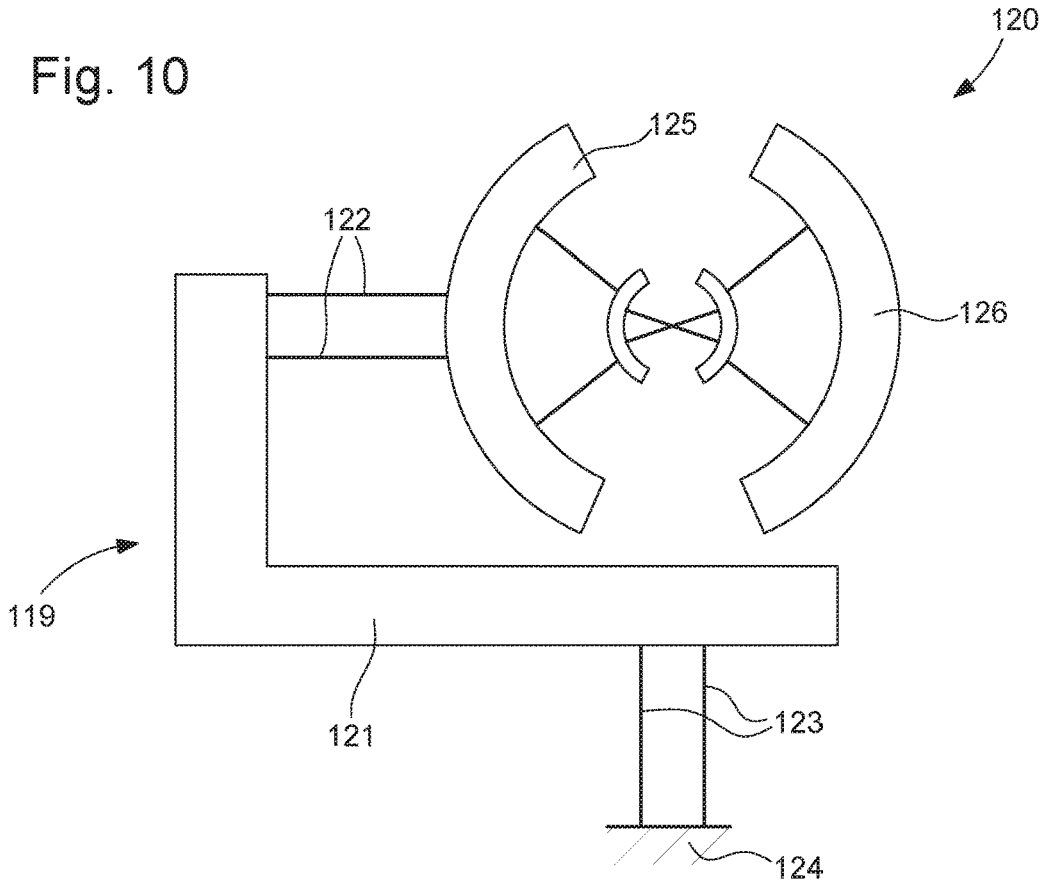

The devices described in the application can be associated with a shockproof table 119, as described in the system 90 of FIG. 10. For example, the device 120 of the second embodiment is linked to an arm of an L-shaped rigid support 121 by a first pair of flexible strips 122. The rigid support 121 is in turn connected to a plate or a bridge 124 by a second pair of flexible strips 123 from the other arm of the L. The shockproof table 119 allows to absorb the jolts in the event of a shock to avoid interfering with the movement of the device 120. In this case, the first support 125 of the device 120 can also be movable. The fourth support 126 of the device 120 is intended to be assembled to a balance.

In all the embodiments, the strips are fixed to the supports by fixed links, for example by embedding in the support. Furthermore, the flexible strips can be strips including rigid portions and flexible portions. A strip can for example be formed of one or more rigid portions connected by flexible strips or flexible necks. A neck, for example, is a narrowing of the thickness of the rigid portion, which makes the neck flexible.

In an advantageous embodiment, the supports and the strips form a one-piece assembly. This one-piece assembly can be produced by technologies of the "MEMS" or "LIGA" type or the like, of silicon or the like, thermally compensated, in particular by a particular local growth of silicon dioxide, in some areas of the part arranged for this purpose, when this one-piece assembly is made of silicon.

The invention claimed is:

1. A device, for guiding a pivoting mass in rotary pivoting, comprising: arranged in series in one of a same plane and a plane parallel to the same plane respectively, a first support, a first pair of uncrossed strips, a second support, a pair of crossed strips, and a third support, the pair of uncrossed strips comprising a first and a second flexible strip connecting the first support to the second support without crossing each other, the pair of crossed strips including a third and a fourth flexible strip connecting the second support to the third support, the third and fourth flexible strips crossing each other between the second and the third support, wherein the third support and the second support are each more radially inward of the device than is the first support.

2. The device according to claim 1, further comprising a fourth support and a second pair of uncrossed strips, the second pair of uncrossed strips including a fifth and a sixth flexible strip connecting the third support to the fourth support without crossing each other.

3. The device according to claim 2, further comprising two assemblies of supports and pairs of superimposed strips, one of the supports forming a support common to the two assemblies.

4. The device according to claim 1, further comprising a fifth and a sixth support, as well as a third and a fourth pair of uncrossed strips, the third one being mounted between the first support and the fifth support, and the fourth one being mounted between the fourth and the sixth support.

5. The device according to claim 4, wherein the fifth support is arranged between the first and the second support, and the sixth support is arranged between the third and the fourth support, when the device is at rest.

6. The device according to claim 4, wherein the fifth support is arranged beyond the first support, and the sixth support is arranged beyond the fourth support.

7. The device according to claim 6, wherein the second and the third support include arms for holding the flexible strips.

8. The device according to claim 6, wherein the fourth support and the first support include arms for holding the flexible strips.

9. The device according to claim 4, wherein the fifth support is configured to be fixed, the other supports being configured to be movable, the sixth support being configured to form or support the pivoting mass.

10. The device according to claim 1, wherein the first support is configured to be fixed, the other supports being configured to be movable.

11. The device according to claim 1, wherein two flexible strips of the same pair are of equal length.

12. The device according to claim 1, wherein two strips of a pair of crossed strips cross each other substantially at their centre.

13. A timepiece resonator mechanism including a pivoting mass arranged to rotatably pivot about a virtual pivot axis, wherein the mechanism includes the rotary pivoting guide device according to claim 1.

14. A horological movement including the timepiece resonator mechanism according to claim 13.

15. The device according to claim 1, wherein the first support, the first pair of uncrossed strips, the second support, the pair of crossed strips, and the third support are arranged in series such that:

the first pair of uncrossed strips are extended from the first support to a first side of the second support, and the pair of crossed strips is extended from a second side of the second support to the third support, and the first side of the second support is opposite to the second side of the second support.

16. A device, for guiding a pivoting mass in rotary pivoting, comprising: arranged in series in one of a same plane and a plane parallel to the same plane respectively, a first support, a first pair of uncrossed strips, a second support, a pair of crossed strips, and a third support, the pair of uncrossed strips comprising a first and a second flexible strip connecting the first support to the second support without crossing each other, the pair of crossed strips including a third and a fourth flexible strip connecting the second support to the third support, the third and fourth flexible strips crossing each other between the second and the third support, wherein the device further comprises a fourth support and a second pair of uncrossed strips, the second pair of uncrossed strips including a fifth and a sixth flexible strip connecting the third support to the fourth support without crossing each other, and a first one of the crossed strips of the pair of crossed strips is on the same plane and a second one of the crossed strips of the pair of crossed strips is on the plane parallel to the same plane.

17. A device, for guiding a pivoting mass in rotary pivoting, comprising: arranged in series in one of a same plane and a plane parallel to the same plane respectively, a first support, a first pair of uncrossed strips, a second support, a pair of crossed strips, and a third support, the pair of uncrossed strips comprising a first and a second flexible strip connecting the first support to the second support without crossing each other, the pair of crossed strips including a third and a fourth flexible strip connecting the second support to the third support, the third and fourth flexible strips crossing each other between the second and the third support, wherein the device further comprises a fifth and a sixth support, as well as a third and a fourth pair of uncrossed strips, the third one being mounted between the first support and the fifth support, and the fourth one being mounted between the fourth and the sixth support, and a first one of the crossed strips of the pair of crossed strips is on the same plane and a second one of the crossed strips of the pair of crossed strips is on the plane parallel to the same plane.

* * * * *